United States Patent [19]

Brouha et al.

[11] Patent Number: 4,616,154

[45] Date of Patent: Oct. 7, 1986

[54] CATHODE RAY TUBE HAVING AN FE-CO-CR SHADOW MASK AND METHOD OF MANUFACTURING SUCH A SHADOW MASK

[75] Inventors: Marcel Brouha; Johannes T. Klomp; Johannes T. C. van Roosmalen, all of Eindhoven, Netherlands

[73] Assignee: U.S. Philips Corporation, New York, N.Y.

[21] Appl. No.: 623,600

[22] Filed: Jun. 22, 1984

[30] Foreign Application Priority Data

Jun. 28, 1983 [NL] Netherlands ..... 8302276

[51] Int. Cl.[4] ..... H01J 29/07; H01J 9/14; C22C 38/18

[52] U.S. Cl. ..... 313/402; 445/47; 148/311; 420/36

[58] Field of Search ..... 313/402, 403, 407, 408; 445/36, 47; 252/513; 75/126 H

[56] References Cited

U.S. PATENT DOCUMENTS 3,050,653 8/1962 Salinger ..... 313/402 X
3,909,928 10/1975 Sato et al. ..... 313/402 X
4,008,105 2/1977 Yuda et al. ..... 75/126 H X

FOREIGN PATENT DOCUMENTS 54-139463 10/1979 Japan ..... 313/402

*Primary Examiner*—Palmer C. DeMeo
*Assistant Examiner*—Sandra L. O'Shea
*Attorney, Agent, or Firm*—David R. Treacy

[57] ABSTRACT

A cathode-ray tube of the post-focusing type comprising color selection means in the form of a ferromagnetic plate having a large number of apertures. The plate is magnetized so that a magnetic quadrupole lens is formed in each aperture. The ferromagnetic plate consists of an Fe-Co-Cr alloy having 25–27% by weight of Co and the remainder essentially Fe.

2 Claims, 5 Drawing Figures

CATHODE RAY TUBE HAVING AN FE-CO-CR SHADOW MASK AND METHOD OF MANUFACTURING SUCH A SHADOW MASK

BACKGROUND OF THE INVENTION

The invention relates to a cathode-ray tube for displaying coloured pictures, comprising in an evacuated envelope means to generate a number of electron beams, a display screen comprising a large number of regions luminescing in different colours, and colour selection means constituted by a ferromagnetic plate having a plurality of apertures which associate each electron beam with luminescent regions of one colour, said plate being magnetized in such manner that a magnetic quadrupole field is formed in each aperture.

Such a cathode-ray tube of the post-focussing type is known from U.S. Pat. No. 4,135,111. The object of post-focussing is to increase the brightness of the displayed picture by increasing the transmission of the colour selection means. In tubes without post-focusing a very large part, for example 80 to 85%, of the electrons are intercepted by the so-called shadow mask. By using post-focusing the apertures in the colour selection means can be enlarged since as a result of the focusing in the apertures the electron spots on the screen are considerably smaller than the apertures so that nevertheless sufficient space exists between the electron spots of the various electron beams.

The electron lens which is formed in the apertures of the shadow mask of the known type is a magnetic quadrupole lens. Since the magnetic field is perpendicular to the electron path, quadrupole lenses are comparatively very strong as a result of which a comparatively small magnetic field will suffice. The characteristic that a quadrupole lens focuses in one direction and defocuses in the direction at right angles thereto is in principle no objection if all quadrupoles have the same orientation. Therefore the luminescent regions of the display screen preferably have the shape of substantially parallel strips the longitudinal direction of which is substantially parallel to the defocusing direction of quadrupole lenses.

Two different alloys have been suggested for the material of the foil of permanent magnetic material which forms the shadow mask of the known tube, namely an alloy which comprises 20% by weight of Fe, 20% by weight of Ni and 60% by weight of Cu, and one which in addition to Fe comprises 27% by weight of Cr, 15% by weight of Co, 1% by weight of Nb and 1% by weight of Al. However, insofar as said alloys already satisfy the requirements which, as regards magnetic properties, are imposed for such an application $H_c \geqq 20$ kA/m
$B_r \geqq 0{,}5$ Tesla
$T_c > 450°$ C.

they do not, however, satisfy the mechanical requirements which are imposed to realise a shadow mask having a desired curvature whether they are in the form of a plate or a foil. A plastic elongation of 8% at least is required for this latter.

SUMMARY OF THE INVENTION

It has now been found that starting from a material of the composition

25–27% by weight of Cr
10–11% by weight of Co, remainder essentially Fe (not counting inevitable impurities), the conflicting requirements as regards magnetic and mechanical properties can be satisfied. More particularly it is possible, starting from this material, to manufacture a flat plate or foil, etching same, then annealing it and magnetizing it and then giving it a desired curvature, in particular a spherical shape.

In agreement with the invention it has been realised that Fe-Co-Cr alloys which comprise Cr in a range from 25–27% by weight, Co in a range from 10–11% by weight, and the remainder essentially Fe, can be produced so that, in the form of a plate or foil in a thickness between 100 and 300 μm, they simultaneously have a coercive force in the range from 25–50 kA/m, a remanence in the range from 0.5 to 1 Tesla and a plastic elongation of at least 8%. In the interest of the mechanical properties the upper limit of the Cr content is 27% by weight, while for the same reason the material does not comprise any intentional additions, such as Nb, Ta, Si, Mn, and the like. Additions make the material brittle. In the interest of magnetic properties the lower limit of the Co-content is 10% by weight.

BRIEF DESCRIPTION OF THE DRAWINGS

The invention will be described in greater detail, by way of example, with reference to the accompanying drawings, of which

DESCRIPTION OF THE PREFERRED EMBODIMENT

Figure 1:
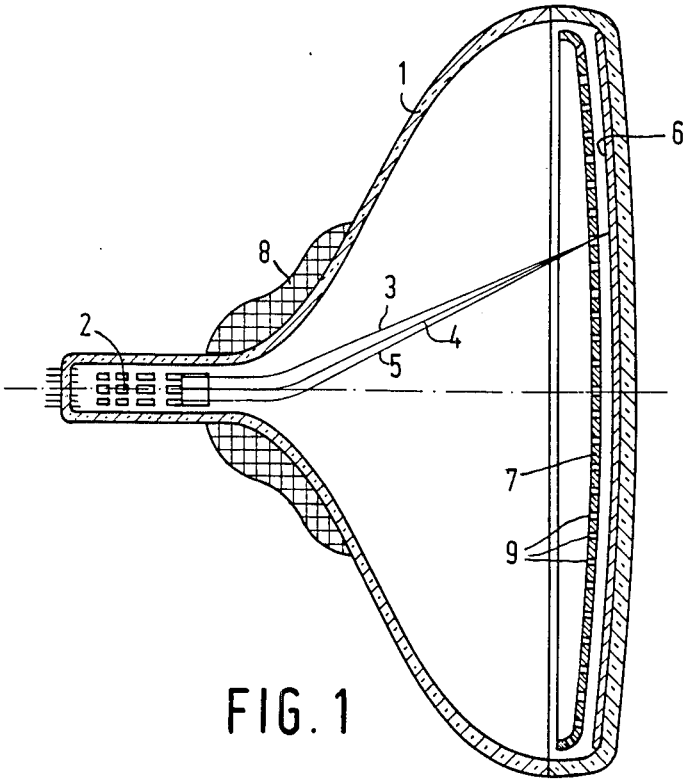
FIG. 1 shows a cathode-ray tube according to the invention for displaying coloured pictures.
Figure 2:
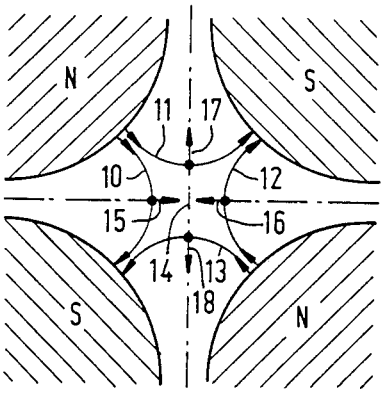
FIG. 2 explains the focusing by means of a magnetic quadrupole lens.

The tube shown in FIG. 1 comprises a glass envelope 1, means 2 to generate three electron beams 3, 4 and 5, a display screen 6, colour selection means 7 and deflection coils 8. The electron beams 3, 4 and 5 are generated in one plane, the plane of the drawing of FIG. 1, and are deflected over the display screen 6 by means of the deflection coils 8. The display screen 6 comprises a large number of phosphor strips luminescing in red, green and blue and the longitudinal direction of which is perpendicular to the plane of the drawing of FIG. 1. During normal operation of the tubes the phosphor strips are vertical and FIG. 1 hence is a horizontal sectional view of the tube. The colour selection means 7 will be described in greater detail with reference to FIGS. 2, 3 and 4 comprise a large number of apertures 9 which are shown diagrammatically only in FIG. 1. The three electron beams 3, 4 and 5 pass through the apertures 9 at a small angle with each other and consequently each impinge only on phosphor strips of one colour. The apertures 9 in the colour selection means 7 are hence very accurately positioned relative to the phosphor strips of the display screen 6.

In the already mentioned U.S. Pat. No. 4,135,111 magnetic quadrupole lenses are formed in the apertures 9 for focusing the electron beams.

The principle of a magnetic quadrupole lens will be described again with reference to FIG. 2. Four magnetic poles which are magnetized cyclically north-south-north-south (N-S-N-S) constitute a magnetic field a few field lines of which are indicated by 10, 11, 12 and 13. An electron beam the axis of which coincides with the axis 14 of the quadrupole lens and the electrons of which move rearwards perpendicularly to the plane of the drawing, experiences the focusing and defocusing forces indicated by the arrows 15, 16, 17 and 18. The cross-section of the electron beam is thus expanded in the vertical direction and made narrower in the horizontal direction.

Figure 3:
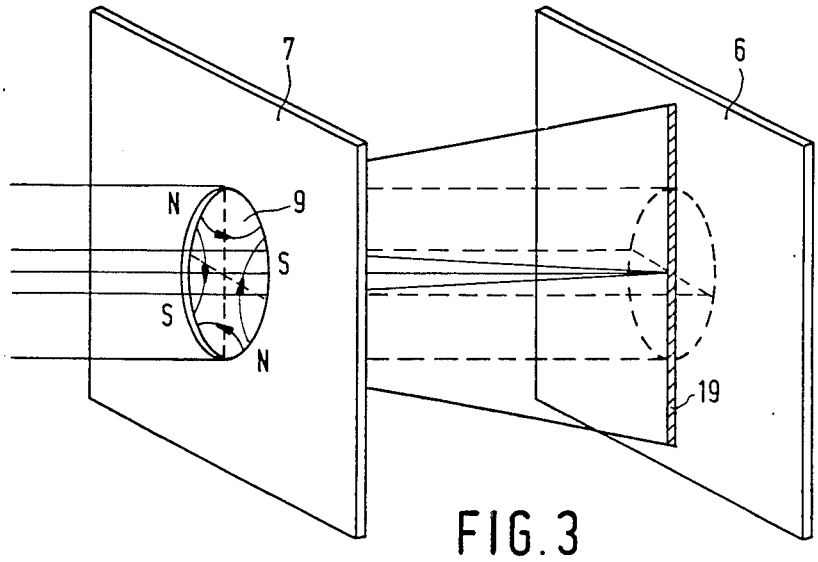
FIG. 3 serves to explain the principle of the invention.

FIG. 3 shows such a magnetic quadrupole lens diagrammatically in an aperture 9 of the colour selection means 7. The variation of the magnetization along the edge of the aperture 9 is indicated by N,S,N,S in such manner that a quadrupole field is formed. The electron beam which passes through the aperture 9 is focused in the horizontally shown plane and is defocused in the vertically shown plane as a result of which, when the display screen is exactly in the horizontal focal point, the electron spot 19 is formed. As will be explained hereinafter it is recommendable not to focus exactly on the display screen 6 as a result of which a slightly brighter electron spot is formed. It is only of minor influence on the focusing when the electron beam passes through the aperture 9 at a small angle as a result of which the colour selection of the three electron beams 3, 4 and 5 takes place in a manner quite analogous to that in the known shadow mask tube. However, as a result of the strong focusing the aperture 9 can be much larger than in the shadow mask tube now used in practice, as a result of which a far greater amount of electrons impinge on the display screen 6 and a brighter picture is formed. The defocusing in a vertical direction need not be any disadvantage if phosphor strips are used which are parallel to the longitudinal direction of the spot 19. Colour selection means having a large number of magnetic quadrupole lenses can be realized as follows.

Alloys for plate-shaped shadow masks for cathode ray tubes according to the invention can be prepared, for example, by moulding from a melt which comprises a mixture containing Fe, Co and Cr in the above-indicated ranges. The treatment of the moulding after moulding is in particular as follows. The moulding is hot-formed, for example by hot-rolling, to a plate having a first thickness and is then cold-formed, for example, by cold-rolling, to form a plate having a second smaller thickness. The reduction of the transverse surface of the plate which occurs is termed the degree of deformation. The required apertures are etched in the resulting plate which for the end in view preferably has a thickness between 100 and 300 μm, and the etched plate is subjected to an annealing treatment. The annealing treatment produces a two-phase structure with permanent magnetic particles in a non-magnetic ductile matrix. The annealing treatment is not optimized with respect to the magnetic properties because it also serves to produce, in combination with the preceding cold deformation step, an alloy within the indicated range of compositions having a plastic elongation of at least 8%.

For that purpose the annealing treatment comprises the following step:

keeping the alloy at a temperature above 650° C.

reducing the temperature to a temperature below 550° C.;

keeping the alloy at the last-mentioned temperature; in which the reduction takes place in an essentially exponential manner or in an essentially linear manner in a number of steps with different cooling rates in which an exponential decrease of the temperature is approached.

Figure 4:
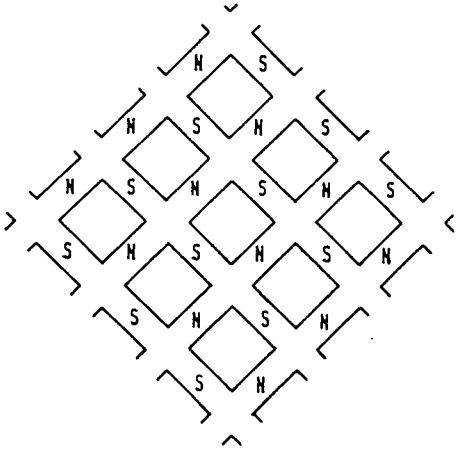
FIG. 4 is an embodiment of a mask according to the invention.
Figure 5:
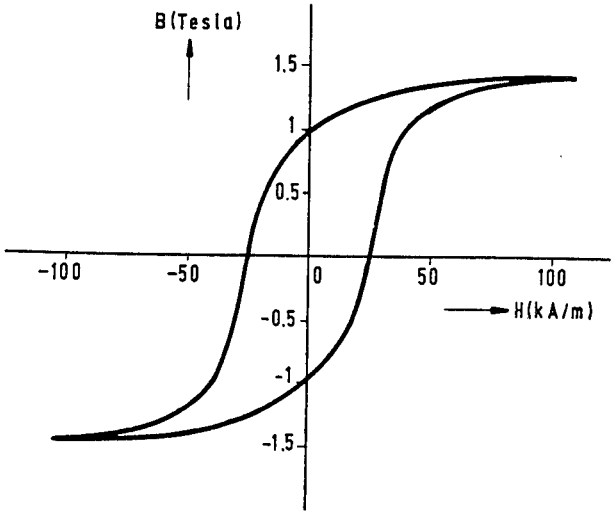
FIG. 5 shows the B-H loop of a magnetic material of the composition of Co 10.5%, Cr 26% and Fe 63.5%.

FIG. 5 shows the B-H loop of an alloy produced in the above manner of the composition Co 10.5%; Cr 26%; Fe 63.5%. The plastic elongation of said alloy after cold deformation was 10%. A foil of said alloy having a thickness of 150 μm was magnetized so that quadrupoles were formed in the apertures (FIG. 4) and it could then easily be formed into a (spherical) shadow mask curved in two mutually perpendicular directions. This was suspended in a mask ring. In itself it is a deviation from the existing techniques of forming objects from Fe-Co-Cr that the magnetization preceeds the ultimate designing step.

An embodiment will be described with reference to FIG. 4. The colour selection means 7 consist of a foil of a permanent magnetic material on the basis of a rollable and, for the manufacture of the apertures 9, etchable Fe-Co-Cr alloy comprising in percent by weight 26% chromium, 10,5% cobalt, remainder iron. After having etched the apertures therein the foil is subjected to a magnetic annealing treatment in such manner that the properties indicated in the the table are obtained.

TABLE

| | | |
|---|---|---|
| Composition: Co 10.5% | Cr 26% | Fe 63.5% |
| $B_r$: ≧0.5 Tesla | | |
| $H_c$: 25 kA/m | | |
| $T_c$: ≧475° C. | | |
| Tensile strength: $10^3$ MP | | |
| Modulus of elasticity: $2.8 \times 10^3$ MP. | | |

The magnetization may be carried out in various manners known to those skilled in the art.

If in the FIG. 4 embodiment the apertures 9 are not square but circular holes having a diameter of 0.92 mm and the pitch between the apertures 9 is 0.8 mm, a transmission of 50% is obtained. WIth a thickness of the foil of 0.15 mm and an energy of the electron beam of 25 keV the focal distance of the quadrupole lenses is smaller than 20 mm. In the case of non-perpendicular incidence of the electron beam (near the corners of the display screen) the focal distance becomes slightly smaller. The spacing between the colour selection means 7 and the display screen 6 is 15 mm in the centre and 10 mm at the edge of the display screen, all this in such manner that the focus of the quadrupole lenses always lies slightly beyond the display screen 6 to prevent a so-called focus ring from becoming visible. Otherwise by causing the magnetization to vary over the colour selection means, a great extent of freedom of the spacing between the colour selection means and the display screen 6 can be obtained.

A display screen for a tube according to the invention can be manufactured by means of a known exposure method in which the colour selection means are displayed on a photo-sensitive layer of a window portion of the tube. In connection with the high transmission of the colour selection means according to the invention the exposure method used must be suitable to display the apertures 9 in a strongly narrowed manner. An exposure method suitable for this purposes uses two or more light sources at some distance from each other as is described in German patent application No. 2,248,878. Of course, a tube according to the invention is also excellently suitable for so-called electronic exposure in which the sensitive layer on the window portion is "exposed" by means of an electron beam.

What is claimed is:

1. In a cathode-ray tube for displaying coloured pictures, including in an evacuated envelope means to generate a number of electron beams, a display screen comprising a large number of regions luminescing in different colours, and colour selection means formed by a ferromagnetic plate having a plurality of apertures which associate each electron beam with luminescent regions of one colour, said plate being magnetized so that a magnetic quadrupole field is formed in each aperture, the improvement comprising said ferromagnetic plate being formed from a foil consisting of an Fe-Co-Cr alloy having 25–27% by weight of Cr, 10–11% by weight of Co, and, not counting inevitable impurities, the remainder essentially Fe, said foil being magnetized after keeping said foil at 650° C. and then reducing the temperature below 550° C., said temperature reduction being accomplished in a substantially exponential manner.

2. A method of manufacturing a magnetized ferromagnetic plate suitable for use as a focusing mask in a color cathode ray tube, comprising the steps:

[a] forming a flat plate of an Fe-Co-Cr alloy having 25–27% by weight of Cr, 10–11% by weight of Co, and, not counting inevitable impurities, the remainder essentially being Fe;

[b] etching apertures in said plate;

[c] magnetically annealing said plate by keeping said plate at a temperature above 650° C., reducing the temperature to a temperature below 550° C., keeping the plate at the last-mentioned temperature, said reduction of temperature taking place in a substantially exponential manner or in a substantially linear manner in a number of steps having various cooling rates, in which an exponential decrease of temperature is approached;

magnetizing said plate;

forming said plate into a desired curved shape suitable for said cathode ray tube.

* * * * *